US006487804B1

(12) United States Patent
Petrella, Jr.

(10) Patent No.: US 6,487,804 B1
(45) Date of Patent: Dec. 3, 2002

(54) FIREARM WITH PERSONAL SAFETY INTERLOCK MECHANISM

(75) Inventor: Joseph R. Petrella, Jr., Ringoes, NJ (US)

(73) Assignee: IMET Corporation, Ringoes, NJ (US)

( * ) Notice: Subject to any disclaimer, the term of this patent is extended or adjusted under 35 U.S.C. 154(b) by 0 days.

(21) Appl. No.: 09/938,070

(22) Filed: Aug. 23, 2001

(51) Int. Cl.[7] ..... F41A 17/00
(52) U.S. Cl. ..... 42/70.11; 42/70.08
(58) Field of Search ..... 42/70.11

(56) References Cited

U.S. PATENT DOCUMENTS

| | | | | | |
|---|---|---|---|---|---|
| 3,370,137 | A | * | 2/1968 | O'Connor | 200/43.07 |
| 4,003,152 | A | * | 1/1977 | Barker et al. | 42/70.01 |
| 4,105,885 | A | * | 8/1978 | Orenstein | 200/42.02 |
| 4,672,763 | A | | 6/1987 | Cunningham | 42/70.11 |
| 4,833,811 | A | | 5/1989 | Wilkinson | 42/70.08 |
| 4,967,502 | A | | 11/1990 | Vernon | 42/70.08 |
| 5,062,232 | A | * | 11/1991 | Eppler | 42/70.11 |
| 5,081,779 | A | * | 1/1992 | Pack | 42/70.11 |
| 5,192,818 | A | * | 3/1993 | Martin | 42/70.01 |
| 5,231,236 | A | * | 7/1993 | Del Real et al. | 42/70.11 |
| 5,235,763 | A | * | 8/1993 | Nosler et al. | 42/66 |
| 5,241,769 | A | * | 9/1993 | Von Muller | 42/70.04 |
| 5,361,525 | A | | 11/1994 | Bowes | 42/70.11 |
| 5,392,552 | A | * | 2/1995 | McCarthy et al. | 42/70.06 |
| 5,433,028 | A | * | 7/1995 | Novak et al. | 42/70.06 |
| 5,459,957 | A | * | 10/1995 | Winer | 42/70.11 |
| 5,465,519 | A | * | 11/1995 | Blanck | 42/70.01 |
| 5,516,150 | A | * | 5/1996 | Goode et al. | 2/161.1 |
| 5,651,206 | A | * | 7/1997 | Matarazzo | 42/66 |
| 5,671,560 | A | | 9/1997 | Meller | 42/70.11 |
| 5,788,500 | A | * | 8/1998 | Gerber | 102/355 |
| 5,887,839 | A | * | 3/1999 | Smith et al. | 2/160 |
| 5,915,936 | A | | 6/1999 | Brentzel | 42/70.11 |
| 5,918,402 | A | * | 7/1999 | Weinraub | 42/70.07 |
| 5,974,717 | A | * | 11/1999 | Brooks | 42/70.02 |
| 5,987,796 | A | * | 11/1999 | Brooks | 42/70.11 |
| 6,125,568 | A | | 10/2000 | Granaroli | 42/70.11 |
| 6,219,952 | B1 | | 4/2001 | Mossberg et al. | 42/70.01 |
| 6,237,271 | B1 | | 5/2001 | Kaminski | 42/70.06 |
| 6,393,614 | B1 | * | 5/2002 | Eichelbaum | 2/158 |

* cited by examiner

*Primary Examiner*—Michael J. Carone
*Assistant Examiner*—Denise J Budley
(74) *Attorney, Agent, or Firm*—Kenneth P. Glynn, Esq.

(57) ABSTRACT

The present invention is a firearm system with a personal safety interlock mechanism which permits only selective personnel to fire a specific firearm. It includes a firearm having a firing mechanism with trigger, and a handle area, a decoding locking mechanism, an engagement assembly and handwear. The decoding/locking mechanism is mounted at the handle area. It has a plurality of recesses with receiving tabs, for transfer of a correct key code to a locking assembly; which is functionally connected to the receiving tabs and to a disabling mechanism. The disabling mechanism has a lock position and an unlock position, and is biased in the lock position for the disengagement of the firing mechanism of the firearm. It is movable to its unlock position by insertion of an engagement assembly with an encoding key located on the handwear and having the correct key code, into the recesses. The handwear may be worn on a trigger hand of selective personnel.

15 Claims, 5 Drawing Sheets

FIREARM WITH PERSONAL SAFETY INTERLOCK MECHANISM

BACKGROUND OF THE INVENTION

1. Field of the Invention

The present invention relates to safety mechanisms for firearms, both elongated firearms, such as shotguns, rifles, bazookas, rocket launchers, grenade launchers and other military small arms, as well as, handguns, especially for military personnel and law enforcement officers. The present invention firearm system involves an engagement assembly affixed to handwear, e.g. a glove, which must be inserted into a mechanism in the firearm before the firearm may be discharged.

2. Information Disclosure Statement

U.S. Patent No. 4,672,763 to Jerry M. Cunningham describes a safety device for preventing the unauthorized firing of a weapon, such as a pistol. The device has a hammer, a handle, and a leaf spring inside of the handle. The leaf spring places tension on the hammer, when the weapon is enabled. The leaf spring is held by a stop member, which is movable. When the stop member is moved to a lower position, the spring is released, and the weapon is disabled. The stop member is moved by a strap and a ring, connected to the stop member. The handle must be taken apart in order to return the spring and the stop member to the enabled condition.

U.S. Patent No. 4,833,811 to Earl Wilkinson describes a safety for hammer-equipped pistols, which includes a lock pin slidably mounted in the handle of a pistol, a companion lock pin spring biasing the lock pin inwardly of the handle toward the hammer, a locking rod slidably mounted in the handle in angular relationship with respect to the lock pin, the upper end of which locking rod is adapted to normally engage a seat provided in the lock pin and a release pin normally located in a release pin seat provided in the base of the handle, for engaging the opposite, or lower end of the locking rod and preventing relative movement between the locking rod and the lock pin. In a preferred embodiment, one end of a release pin cable is attached to the release pin and the opposite end of the cable is secured to the pistol holder, wherein seizure and extension of the pistol beyond the length of the cable pulls the release pin from the release pin seat and allows the locking rod to slide downwardly inside the pistol handle and facilitate forward projection of the lock pin responsive of the lock pin spring and the locking of the hammer to prevent firing of the pistol.

The apparatus of U.S. Patent No. 4,967,502 to Terry M. Vernon is adapted to be used in a firearm of the type having a body having an interior space, a hammer supported by the body for movement, and a trigger for actuating the hammer. A strut member is located in the interior space of the body and has one end pivotally connected to the hammer. A capsule is provided having first and second ends and a spring means located therein. Opening means is formed at the first end of said capsule whereby the spring means may be compressed by applying force to the spring means by way of said opening means. The capsule is adapted to be supported by the body in a given position relative to the second end of the strut member whereby the other end of the strut member will apply force to the spring means, by way of said opening means to allow sufficient spring compression to occur such that the hammer will fire the firearm when actuated by the trigger. Means is provided for releasably holding the capsule in the given position for firing purposes and for allowing the capsule to be released from the given position for releasing spring compression to disable the firearm. In one embodiment, the capsule is completely removable from the firearm. In another embodiment, a releasable keeper is provided which is movable into an opening for engaging the other end of the capsule for moving the capsule to the given position and for holding the capsule in the given position for firing purposes. The keeper may be released to allow the capsule to be moved away from the given position for disabling purposes.

U.S. Patent No. 5,361,525 to Kenneth E. Bowes describes an improved gun safety lock which employs a barrel key to enable the firing mechanism of the gun. The barrel key is inserted in the handle of the gun to allow the hammer of the weapon to be moved into a cocked or firing position. The barrel key is unique for each gun. The barrel key is held in the gun by retaining lugs. A lanyard attaches to the barrel key on one end and to the owner of the gun on the other end. Pressure on the lanyard causes the key to pull out of the gun and thereby disables the gun.

U.S. Patent No. 5,671,560 to Yehuda Meller describes a firearm including a frame having a grip for manually grasping the firearm, a control member movable to enable firing the firearm, a locking device including a latch element movable by an-inserted key either to a locking position or a releasing position, and a locking member movably carried by the frame. A spring urges the locking member into contact with the control member such that the locking member moves with the control member to enable firing the firearm. The locking member is located with respect to the latch element of the locking device so as to be engaged thereby when the latch element is in its locking position, to block the movement of the locking member, and thereby to prevent the firing of the firearm when the latch element is in its locking position. Two embodiments are described: a semi-automatic pistol, wherein the control member is a pivotal safety lever; and a revolver, wherein the control member is a rebound slide.

U.S. Patent No. 5,915,936 to John Charles Brentzel describes a firearm with an identification safety system for preventing use by an unauthorized user. The firearm includes a barrel for discharging the firearm therethrough, a butt section connected to the barrel, a trigger connected between the barrel and butt section for initiating discharge of the firearm and a safety switch operable between a first position preventing discharge of the firearm and a second position allowing discharge of the firearm. A pressure sensor is positioned in the butt section for sensing grasping of the butt section by a palm of a user and a scanning sensor is connected for scanning a palm print of the palm of the user and generating a data signal representative of the scanned palm print upon sensing grasping of the butt section by the pressure sensor. A memory unit stores data signals representative of the palm prints of authorized users and a microprocessor is connected to both the scanning sensor and the memory unit for receiving the data signal from the scanning sensor and comparing the received data signal to the data signals stored in the memory unit. The microprocessor controls the safety switch to operate in the first position upon determining the received data signal does not match any of the data signals stored in the memory unit and controls the safety switch to operate in the second position upon determining the received data signal matches one of the data signals stored in the memory unit.

U.S. Patent No. 5,987,796 to Frank Brooks describes a firearm safety mechanism having a self-contained locking mechanism incorporated into the magazine of a semi-automatic pistol which inhibits use of the firearm when a locking mechanism disarms the firing mechanism as well as locking the magazine in position so as to prevent unauthorized replacement. The firearm can be locked against unauthorized use and unlocked by an authorized user without resort to external accessories.

U.S. Patent No. 6,125,568 to George Granaroli describes a firearm lock 20 having a combination lock 20 for firearms 10 which uses four tumbler locking mechanisms 22, 24, 26 and 28 connected to the firing trigger 16 mechanism by way of a trigger deactuator rod 38. The trigger 16 firing mechanism is disabled until the four or more tumblers 22, 24, 26 and 28 of the combination lock 20 are positioned in such a way as to allow a preselected combination or pin number on the tumblers to communicate with a tumbler pin 44, 46, 48 and 50 attached to the trigger deactuator rod 38. When the numbers of the disk tumblers 22, 24, 26 and 28 are properly entered, the tumbler pins 44, 46, 48 and 50 of the trigger deactuator rod 38 will seat in a single hole and thereby allow the trigger 16 firing mechanism to be actuated. If the wrong number of the combination is entered, the tumbler pin will contact a false hole after traveling only a short distance thereby locking and preventing the trigger mechanism from firing.

U.S. Patent No. 6,219,952 to Mossberg et al. describes a firearm safety enhancement system which is provided for enabling use of a firearm only by an authorized individual. At least one electrically activated preventer is provide having a first position for preventing use of firearm and having a second position for enabling use of the firearm. An electrical activation circuit is operatively connected to the preventer to move the preventer between the first and second positions. A portable power supply is carried in said firearm and is coupled to the activation circuit for providing power. A power signal transmitter is operatively connected to the power supply for transmitting an electromagnetic power signal at a regular frequency. A passive identification tag is mounted to a personal adornment to be carried or worn by an individual and is preprogrammed with an authorized identification code preselected from a large number of available identification codes. The passive identification tag is responsive to the power signal to impose a coded return signal on the power signal. The returned coded signal is representative of the preprogrammed authorized identification code so that the power signal acts as a carrier of the imposed coded return signal. A reader circuit is connected to the power signal transmitter and to the electrical activation circuit. The reader circuit is responsive only to an authorized identification code to activate the electrical activation circuit to provide power from the portable power supply to move the at least one preventer between the first preventing position and the second unblocked position for enabling use of the firearm.

U.S. Patent No. 6,237,271 to Kevin A. Kaminski describes a module having a housing, a battery, control circuitry and electrical conductors. The battery and control circuitry are contained in the housing. The housing is adapted to be removably connected to the frame of a firearm. The electrical conductors are located on the housing and allow the battery and control circuit to be electrically connected to other components of the firearm. The housing can be connected at a hand grip section of the firearm and forms a substantial portion of at least one exterior side of the firearm at the hand grip section.

Notwithstanding the prior art, the present invention is neither taught nor rendered obvious thereby.

SUMMARY OF THE INVENTION

The present invention is-a personal safety interlock device for use in firearms. Specifically, the present invention may be used in handguns and long arms where the trigger hand is engaged with the firearm for firing. The present invention device allows the firing of the firearm only after the locking mechanism is successfully encoded through the application of a key with a specific number of coded protrusions.

One critical aspect of the present invention device is the encoding key, which is affixed to a glove or a strap to be worn on the trigger hand, and is typically positioned between the thumb and pointer finger. This encoding key is the male partner of a receiving mechanical decoder on the firearm's stock and/or grip. It is with the action of gripping the firearm that the key, upon proper encryption, releases the lock mechanism which unlocks a disabling mechanism and a firing mechanism, that allows the firing of the firearm.

Another critical aspect of the present invention device is the method in which the unlocking code is transferred to the firearm. With attachment of the encoding key with a correct code to a glove or strap that is worn on the trigger hand, the motion of unlocking the firearm is very similar to the positioning of the hand for firing, resulting in a passive locking system which is deactivated along with the primary motion of holding the firearm. Because the present invention device performs its functions through mechanical motions only, the entire mechanism is simplified.

Thus, the present invention firearm system involves a plurality of recessed receiving tabs in the stock or grip of the firearm for mechanical transfer of a correct key code to a locking assembly. The locking assembly is functionally connected to the receiving tabs and to a disabling mechanism, for receiving the correct key code and rejecting incorrect key code via the tabs, from an encoding key. There is a disabling mechanism connected to the locking assembly which has a lock position and an unlock position, and is biased in the lock position for the disengagement of the firing mechanism of the firearm. This disabling mechanism is movable to its unlock position by insertion of an encoding key having the correct key code, into the recesses with the receiving tabs. There is also a unique engagement assembly attached to separate handwear, containing an encoding key with a plurality of protrusions having the correct key code and corresponding to the tabs for transfer of the correct key code to the receiving tabs, to move the disabling mechanism from its lock position to its unlock position when the encoding key is engaged with the tabs.

There is handwear in the present invention system, such as a glove or hand strap to be worn on a trigger hand of selective personnel. This handwear has an engagement assembly with the encoding key attached thereto for quick insertion and removal by the wearer into the recesses of the firearm.

In one preferred embodiment of the present invention firearm system, the locking assembly includes a plurality of tumbler pins biased in a locked position and adapted to shift in response to the receiving tabs being moved by the encoding key having the correct key code, so as to move the disabling mechanism from its lock position to its unlock position. For example, the disabling mechanism includes a swing lever and spring wherein the spring biases the swing lever in its lock position so as to prevent the firing mechanism from firing until a correct key code engagement assembly is inserted into the tab recesses. In this embodiment, the swing lever may be positioned relative to the locking assembly and the firing mechanism so as to be moved from its unlock position to its lock position by the cocking of the firing mechanism.

The tab recesses of the present invention firearm system may be located on the stock of a rifle, the handle of a bazooka or rocket launcher, or on a rear portion of a handle area of a handgun. The engagement assembly may be located in a palm area of the handwear and would be strategically placed for easy insertion.

The firearm system of the present invention includes a firearm with an independent safety mechanism which operates independently of said decoding/locking mechanism.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
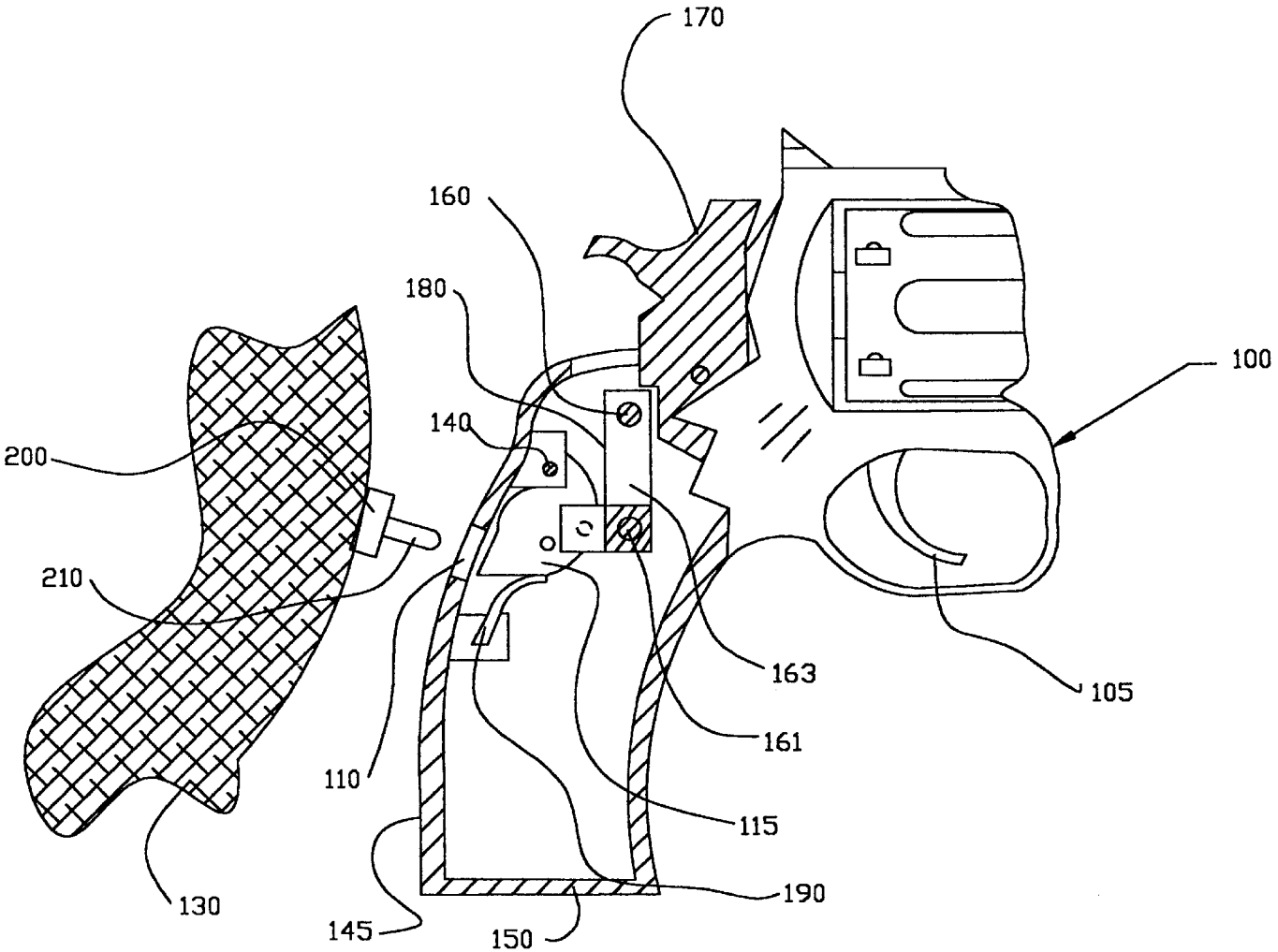
FIG. 1 shows a partial side cut view of a handgun with the present invention system.

Referring now to FIG. 1, there is shown a side partial cut view of a present invention firearm system for a handgun 100, which includes a trigger 105 and a firing mechanism hammer 170.

Figure 2:
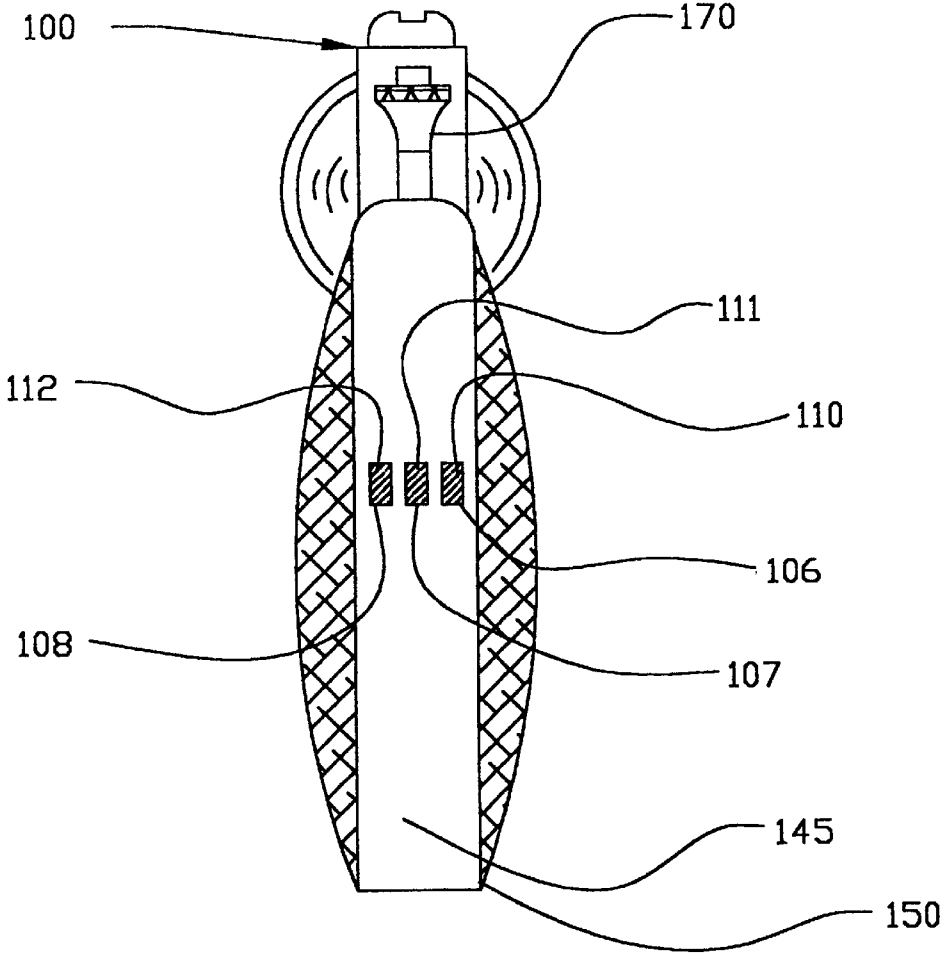
FIG. 2 shows a rear view thereof.

Referring to FIGS. 1 and 2 together, FIG. 2 showing a rear view of handgun 100, identical parts are identically numbered. There are recesses 106, 107 and 108 which contain receiving tabs 110, 111 and 112 which are located on a rear portion 145 of handle 150. These receive key protrusions such as protrusion 210 of engagement assembly 200 attached to a glove (partial view) 130. These key protrusions have a correct key code corresponding to the receiving tabs 110, 111 and 112, when inserted, unlock a locking mechanism 115 and moving disabling mechanism 180 from a lock position to an unlock position to permit the firing of firing mechanism hammer 170. Disabling mechanism 180 includes, in this embodiment, a slide bar 163 and slide pins 160 and 161. Locking mechanism 115 includes a leaf spring 190 which biases it in its locked position, as shown in FIG. 1. Hinge pin 140 establishes the point of rotation for the receiving tabs and enables the connective movement of slide bar 163.

Figure 3:
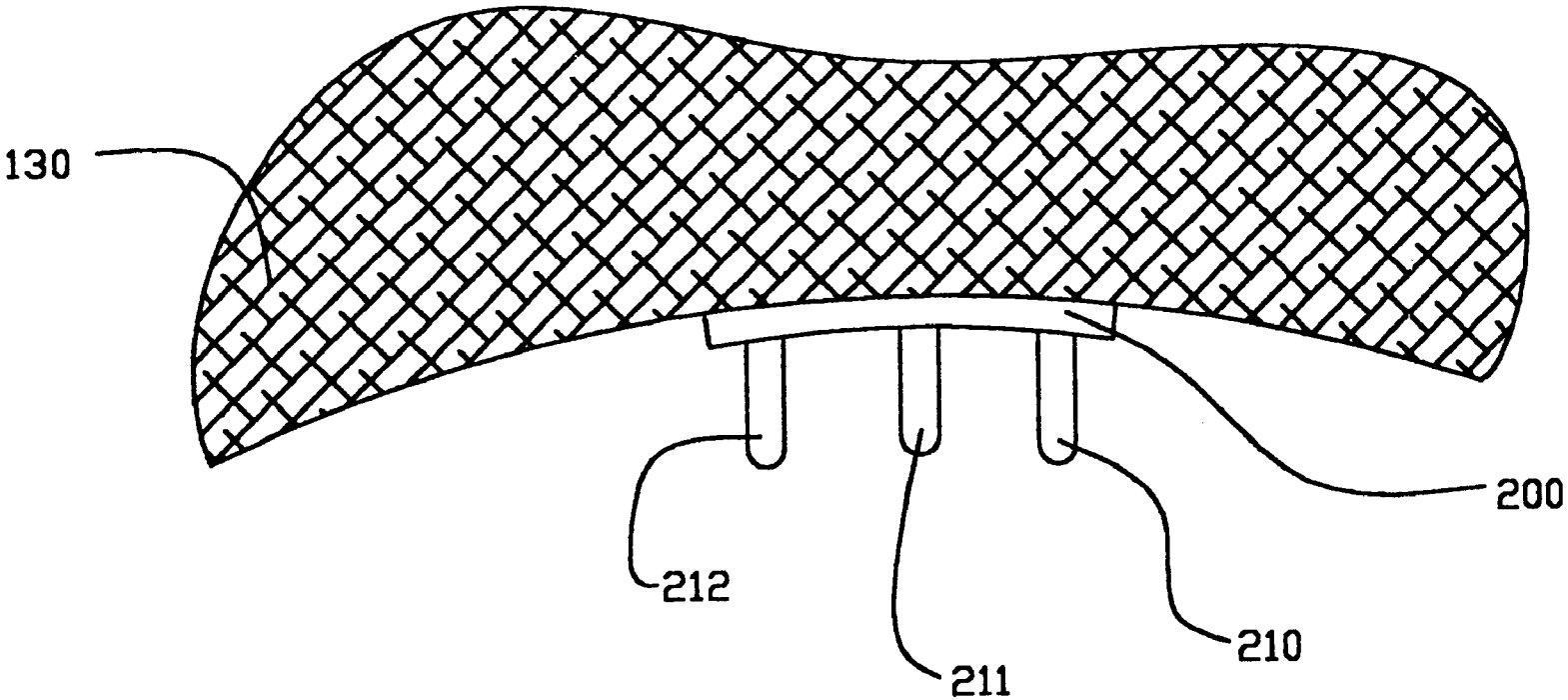
FIG. 3 shows an end view of a glove and key code engagement assembly.

FIG. 3 shows a side view of engagement assembly 200 with key protrusions 210, 211 and 212. Engagement assembly is attached to glove fabric 130. The engagement assembly 200 and glove 130 function with respect to the present invention mechanism shown in FIG. 4 and as illustrated in FIG. 5.

Figure 4:
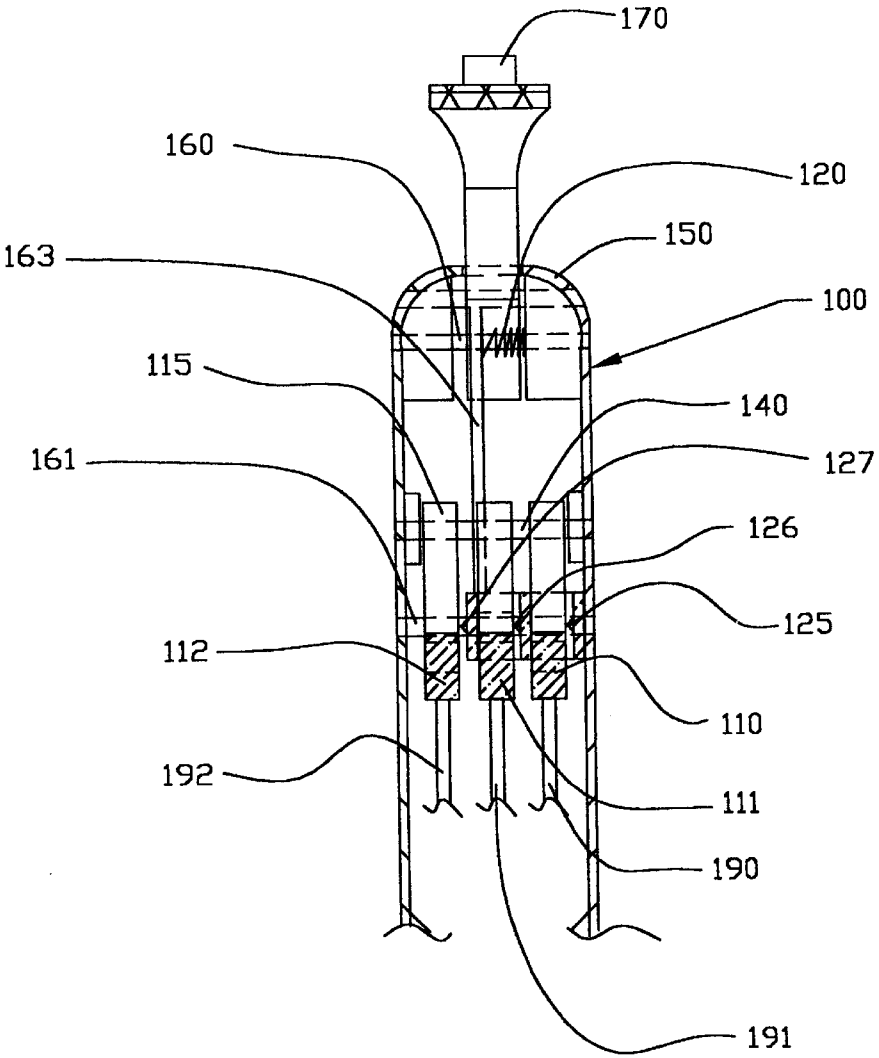
FIG. 4 shows a partial cut end view of a present invention system mechanism; and, FIG. 5 shows a side view of a users hand and a firearm with the present invention system.
Figure 5:
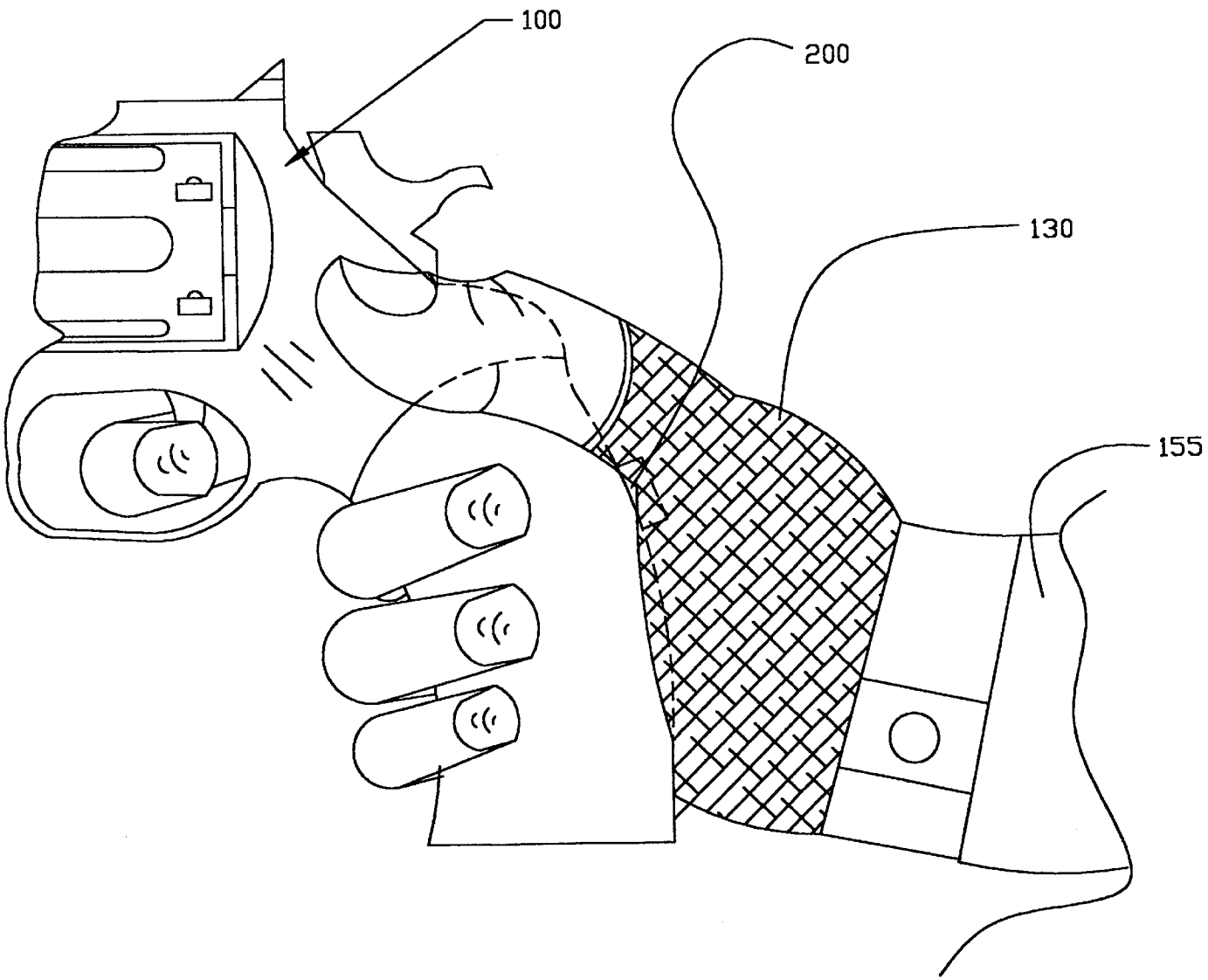

Referring now to FIG. 4, there is a cut end view of handgun 100, with identical parts identically numbered. Locking mechanism 115 includes receiving tabs 110, 111 and 112, which in response to a correct key code engagement, activates tumbler pins 125, 126 and 127 which allows spring 120 to cause the movement of slide bar 163 so as to release the disabling mechanism, thereby enabling a user to fire the handgun. Leaf springs 190, 191 and 192 retain the tabs 110, 111 and 112 in their locked position until a correct key code engagement permits movement and force against these springs. FIG. 5 shows handgun 100 being held by a user's hand 155 wearing a glove containing engagement assembly 200 which has been inserted into the recesses with a correct key code to permit firing of handgun 100.

Variations with respect to the locking mechanism may be made with out exceeding the scope of the present invention. Likewise, the number of protrusions, as long as there are a plurality of protrusions, the location of the recesses and the type of arms may be of numerous varieties with out exceeding the scope of the present invention. obviously, numerous modifications and variations of the present invention are possible in light of the above teachings. It is therefore understood that within the scope of the appended claims, the invention may be practiced otherwise than as specifically described herein.

What is claimed is:

1. A firearm system with a personal safety interlock mechanism which permits only selective personnel to fire a specific firearm, which comprises:

(a) a firearm having a conventional firing mechanism with a trigger, and having a handle area;

(b) a decoding/locking mechanism mounted in said handle area of the firearm, containing;

(i) a plurality of recesses with receiving tabs, said receiving tabs representing a correct key code for transfer of key code to a locking assembly;

(ii) the locking assembly functionally connected to said receiving tabs and to a disabling mechanism, for receiving said correct key code and rejecting incorrect key code via said receiving tabs, from an encoding key, wherein said locking assembly includes a plurality of tumbler pins biased in a locked position and adapted to shift in response to said receiving tabs being moved by said encoding key having said correct key code so as to move said disabling mechanism from its lock position to an unlock position; and, (iii) said disabling mechanism connected to said locking assembly having said lock position and said unlock position, and being biased in said lock position for the disengagement of the firing mechanism of the firearm and being movable to its unlock position by insertion of the encoding key having said correct key code, into said recesses with said receiving tabs;

(c) a unique, separate engagement assembly attached to a glove, containing the encoding key with a plurality of protrusions having said correct key code corresponding to said receiving tabs for transfer of said correct key code to said receiving tabs, to bias said disabling mechanism from its lock position to its unlock position when said encoding key is engaged with said receiving tabs; and, (d) the glove to be worn on a trigger hand of selective personnel and having said engagement assembly attached thereto.

2. The firearm system of claim 1 wherein said glove is a handstrap type glove.

3. The firearm system of claim 1 wherein said disabling mechanism includes a swing lever and spring wherein said spring biases said swing lever in its lock position so as to prevent said firing, mechanism from firing.

4. The firearm system of claim 3 wherein said swing lever is positioned relative to said locking assembly and said firing mechanism so as to be moved from its unlock position to its lock position by cocking of said firing mechanism.

5. The firearm system of claim 1 wherein said firearm includes an independent safety mechanism which operates independently of said decoding/locking mechanism.

6. The firearm system of claim 1 wherein said recesses are located on a rear portion of said handle area.

7. The firearm system of claim 6 wherein said engagement assembly is located in a palm area of said glove.

8. The firearm system of claim 1 wherein said encoding key includes said plurality of key protrusions which are equal to or less than the number of said plurality of recesses.

9. A firearm system with a personal safety interlock mechanism which permits only selective personnel to fire a specific firearm, which comprises:

(a) a firearm having a conventional firing mechanism with a trigger, and having a handle area;

(b) a decoding/locking mechanism mounted in said handle area of said firearm, containing;

(i) a plurality of recesses with receiving tabs, said receiving tabs representing a correct key code for transfer of a key code to a locking -assembly;

(ii) the locking assembly functionally connected to said receiving tabs and to a disabling mechanism, for receiving said correct key code and rejecting incorrect key code via said receiving tabs, from the encoding key, and, (iii) the disabling mechanism connected to said locking assembly having said lock position and said unlock position, and being biased in said lock position for the disengagement of the firing mechanism of the firearm and being movable to its unlock position by insertion of the encoding key having said correct key code, into said recesses with said receiving tabs wherein said disabling mechanism includes a swing lever and a spring, wherein said spring biases said swing lever in its lock position so as to prevent said firing mechanism from firing;

(c) a unique, separate engagement assembly attached to a glove, containing an encoding key with a plurality of protrusions having said correct key code corresponding to said receiving tabs for transfer of said correct key code to said receiving tabs, to bias said disabling mechanism from its lock position to its unlock position when said encoding key is engaged with said receiving tabs; and, (d) the glove to be worn on a trigger hand of selective personnel and having said engagement assembly attached thereto.

10. The firearm system of claim 9 wherein said glove is a handstrap type glove.

11. The firearm system of claim 9 wherein said swing lever is positioned relative to said locking assembly and said firing mechanism so as to be moved from its unlock position to its lock position by cocking of said firing mechanism.

12. The firearm system of claim 9 wherein said firearm includes an independent safety mechanism which operates independently of said decoding/locking mechanism.

13. The firearm system of claim 9 wherein said recesses are located on a rear portion of said handle area.

14. The firearm system of claim 13 wherein said engagement assembly is located in a palm area of said glove.

15. The firearm system of claim 9 wherein said encoding key includes said plurality of protrusions which are equal to or less than the number of said plurality of recesses.

* * * * *